US007290507B2

(12) United States Patent
Mizuno et al.

(10) Patent No.: US 7,290,507 B2
(45) Date of Patent: Nov. 6, 2007

(54) LOWER LINK FOR PISTON CRANK MECHANISM OF ENGINE

(75) Inventors: Hideaki Mizuno, Yokohama (JP); Kenshi Ushijima, Kanagawa (JP); Katsuya Moteki, Tokyo (JP); Takashi Mori, Kanagawa (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 42 days.

(21) Appl. No.: 11/296,256

(22) Filed: Dec. 8, 2005

(65) Prior Publication Data

US 2006/0137629 A1 Jun. 29, 2006

(30) Foreign Application Priority Data

Dec. 24, 2004 (JP) ..... 2004-372471

(51) Int. Cl.
*F02B 75/04* (2006.01)

(52) U.S. Cl. ..... 123/48 B; 123/78 F; 123/197.1

(58) Field of Classification Search ..... 123/197.3, 123/197.4, 78 E, 48 B, 78 F, 197.1
See application file for complete search history.

(56) References Cited

U.S. PATENT DOCUMENTS 6,561,142 B2 * 5/2003 Moteki et al. ..... 123/48 B
7,121,251 B2 * 10/2006 Moteki et al. ..... 123/197.1
2002/0026910 A1 * 3/2002 Hiyoshi et al. ..... 123/48 B
2002/0144665 A1 * 10/2002 Ushijima et al. ..... 123/48 B
2004/0112169 A1 * 6/2004 Hiyoshi et al. ..... 74/579 R
2004/0261733 A1 * 12/2004 Henig et al. ..... 123/78 E
2005/0005897 A1 * 1/2005 Takahashi et al. ..... 123/197.4
2005/0045120 A1 * 3/2005 Moteki et al. ..... 123/48 B
2005/0061270 A1 * 3/2005 Yamada ..... 123/78 E
2005/0178353 A1 * 8/2005 Yaguchi et al. ..... 123/197.3
2006/0096810 A1 * 5/2006 Eto et al. ..... 184/6.5
2007/0044739 A1 * 3/2007 Clarke ..... 123/78 F
2007/0044740 A1 * 3/2007 Watanabe et al. ..... 123/78 F

FOREIGN PATENT DOCUMENTS

JP 2004-124776 A 4/2004

* cited by examiner

*Primary Examiner*—Noah P. Kamen
(74) *Attorney, Agent, or Firm*—Foley & Lardner LLP

(57) ABSTRACT

A lower link for an engine piston crank mechanism includes first and second half members joined by bolts to form a crankpin bearing portion. The first half member includes a first pin boss portion to connect the lower link with a first link which is one of an upper link connected with a piston and a control link having one end mounted swingably on the engine. The second half member includes a second pin boss portion to connect the lower link with a second link which is the other of the upper link and the control link, and an internally threaded portion into which one bolt is screwed. The second half member further includes a load transfer portion which is made greater in rigidity than the internally threaded portion.

19 Claims, 7 Drawing Sheets

LOWER LINK FOR PISTON CRANK MECHANISM OF ENGINE

BACKGROUND OF THE INVENTION

The present invention relates to a link used in a piston crank mechanism for a reciprocating internal combustion engine, and more specifically to a link in a multi-link piston crank mechanism.

A Published Japanese Patent Application Publication No. 2004-124776 shows a multi-link piston crank mechanism including a lower link which is mounted on a crankpin and which includes a first end connected with a piston through an upper link and an upper pin swingably connecting the upper and lower links, and a second end connected through a control pin with a control link having one end supported swingably on the engine. The lower link of this publication is composed of an upper half member and a lower half member which are joined, in a parting plane passing through the center of the crank pin bearing portion, by bolts inserted from the lower half member and screwed into respective threaded holes formed in the upper half member.

SUMMARY OF THE INVENTION

The lower link receives combustion pressure acting on the piston, from the upper link through the upper pin, and transmits the force to the crankpin by acting like a lever with the control pin as a fulcrum. Therefore, the lower link requires the strength and rigidity to support the upper pin, control pin and crankpin rotatably, and hold the positional relationship among them when forces are inputted to the lower link from the pins. However, the threaded holes are liable to cause stress concentration, as mentioned later with reference to FIG. 7.

According to one aspect of the present invention, a lower link for a piston crank mechanism of an internal combustion engine, comprises: a first half member which includes, a first half of a crankpin bearing portion defining a central hole adapted to receive a crankpin of a crankshaft, a first pin boss portion located on a first side of the crankpin bearing portion and adapted to receive a first pin to connect the lower link with a first link which is one of an upper link having a first end connected with a piston of the engine and a second end connected with the lower link, and a control link having a first end connected with the lower link and a second end mounted swingably on the engine, and a bolt through hole extending through the first half member; and a second half member which is joined with the first half member by a first bolt located on one side of the crankpin bearing portion and a second bolt located on the other side of the crankpin bearing portion, and which includes, a second half of the crank pin bearing portion which is joined with the first half of the crankpin bearing portion to make up a whole of the crankpin bearing portion, a second pin boss portion formed on a second side of the crankpin bearing portion opposite to the first side and adapted to receive a second pin to connect the lower link with a second link which is the other of the upper link and the control link; an internally threaded portion defining a threaded through hole which extends, through the second half member, from a first open end to a second open end and arranged to receive the second bolt inserted through the bolt through hole of the first half member and screwed into the threaded through hole from the first open end to the second open end, to join a joint surface of the first half member and a joint surface of the second half member together, and a load transfer portion which is made greater in rigidity than the internally threaded portion so as to separate, from the internally threaded portion, a stress transfer path transmitting stress acting in the lower link among the first pin boss portion, the crankpin bearing portion and the second pin boss portion.

According to another aspect of the invention, a lower link comprises: an upper pin boss portion adapted to be connected through an upper pin with a first end of an upper link having a second end connected with a piston of the engine; a control pin boss portion adapted to be connected through a control pin with a first end of a control link having a second end to be supported swingably on the engine; a crankpin bearing portion which defines a central hole adapted to receive a crankpin of a crankshaft and which is located between the upper pin boss portion and the control pin boss portion; an upper half member including a first side portion formed with the upper pin boss portion, a second side portion and a middle portion located between the first and side portions and formed with a half of the crankpin bearing portion; a lower half member including a first side portion formed with the control pin boss portion, a second side portion and a middle portion located between the first and second side portions of the lower half member and formed with a half of the crankpin bearing portion; a plurality of bolts joining the first side portion of the upper half member with the second side portion of the lower half member, and the first side portion of the lower half member with the second side portion of the upper half member; at least one of the upper and lower half members being a rib-reinforced half member which includes, an inner portion defining a threaded through hole extending through the second side portion of the rib-reinforced half member, including first and second open ends, and receiving one of the bolts screwed into the threaded through hole from the first open end to the second open end, and a reinforcing rib structure framing the inner portion.

DETAILED DESCRIPTION OF THE INVENTION

Figure 1:
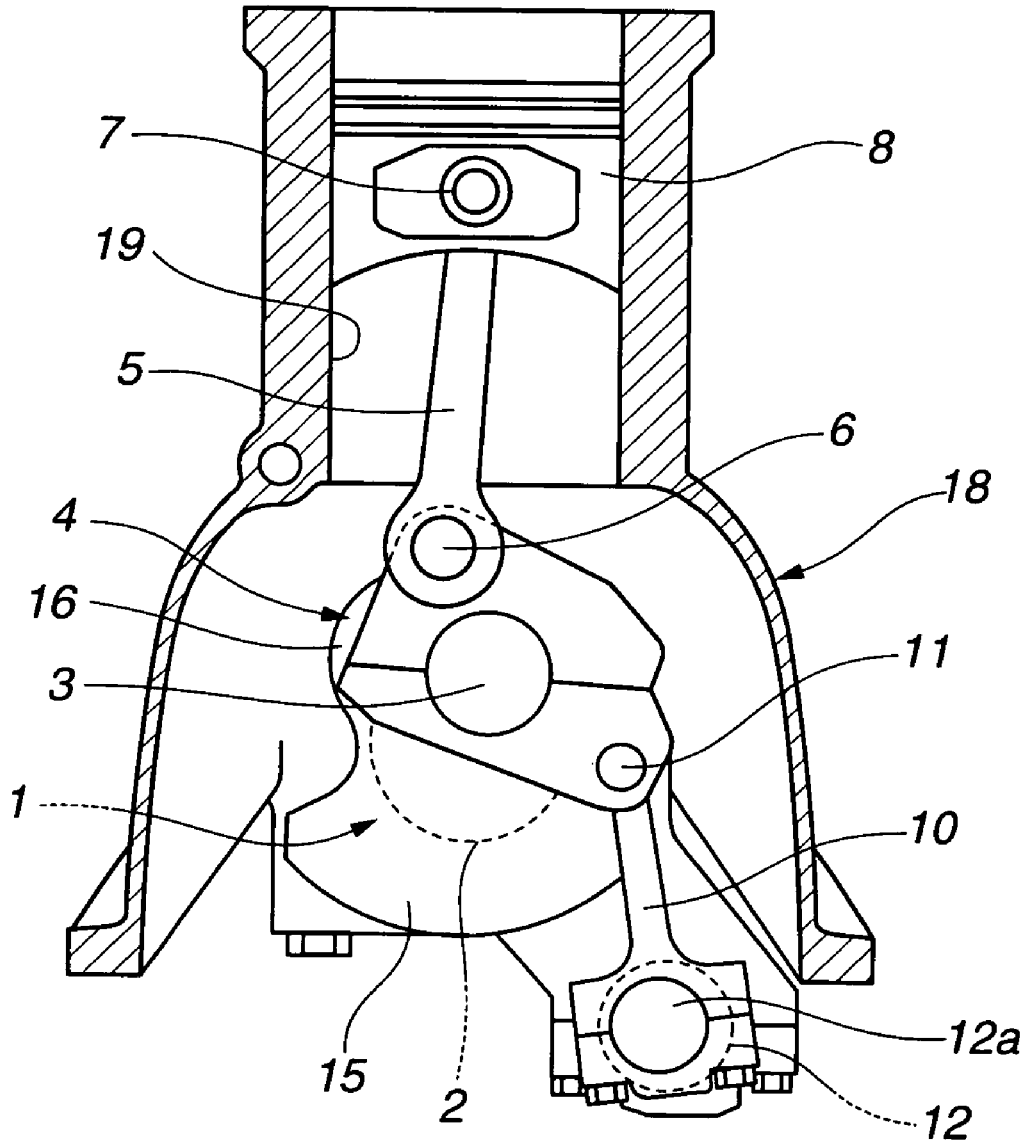
FIG. 1 is a view for illustrating an internal combustion engine equipped with a piston crank mechanism having a lower link according to a first embodiment of the present invention.

FIG. 1 shows a multi-link piston crank mechanism according to a first embodiment of the present invention. This multi-link piston crank mechanism is constructed as a variable compression ratio mechanism. The multi-link piston crank mechanism is a link mechanism or linkage including a lower link 4, an upper link 5 and a control link 10, as link bars or hinged bars.

A crankshaft 1 includes journals 2 and crankpins 3. Journals 2 are rotatably supported by main bearings of a cylinder block 18. Crankpins 3 are displaced from journals 2. Counterweights 15 extend in a direction opposite to a direction toward crankpins 3, from crank webs 16 connecting journals 2 and crankpins 3.

Lower link 4 shown in FIG. 1 is rotatably mounted on one of crankpins 3. As shown in FIG. 1, lower link 4 is composed of two separate members joined together. Lower link 4 includes a central hole in which the crankpin 3 is fit.

Upper link 5 shown in FIG. 1 extends from an upper end to a lower end. The lower end of upper link 5 is rotatably connected with a first end of lower link 4 through an upper pin 6. The upper end of upper link 5 is rotatably connected, through a piston pin 7, with a piston 8 receiving combustion pressure and reciprocating in a cylinder 19 formed in cylinder block 18.

Control link 10 is arranged to restrict the motion of lower link 4. Control link 10 extends from an upper end to a lower end. The upper end of control link 10 is connected rotatably through a control pin 11 with a second end of lower link 4. The lower end of control link 10 is rotatably supported through a control shaft 12 on a lower part of cylinder block 18. Namely, control shaft 12 is rotatably supported on the lower part of cylinder block 18. The lower end of control link 10 is rotatably mounted on an eccentric cam 12*a* of control shaft 12.

To vary the compression ratio of the engine, an engine control unit delivers a drive signal to a variable compression ratio actuator, and thereby rotates control shaft 18 with the actuator. Therefore, the center of eccentric cam 12*a* serving as the swing axis of the lower end of control link 10 is shifted relative to cylinder block 18, and the constraint condition of lower link 4 by control link 10 is varied. In this way, the compression ratio varying mechanism can vary the engine compression ratio by altering the stroke of piston 8 and thereby shifting the potion of the top dead center of piston 8 upward or downward.

Figure 2:
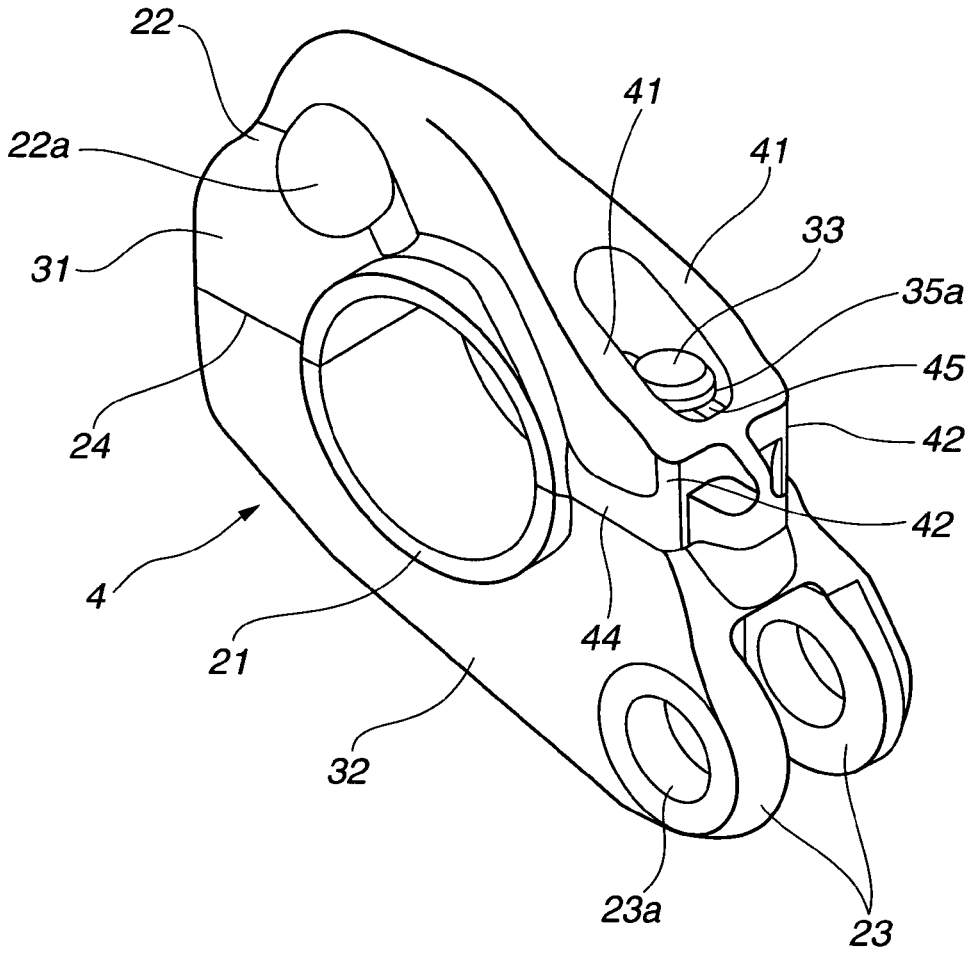
FIG. 2 is a perspective view showing the lower link according to the first embodiment.

FIG. 2 shows, more in detail, lower link 4 according to the first embodiment.

As shown in FIG. 2, lower link 4 includes a crankpin bearing portion 21, an upper pin boss portion 22 for supporting upper pin 6, and a control pin boss portion 23 for supporting control pin 11. Crankpin bearing portion 21 is located approximately at the center of lower link 4, between upper pin boss portion 22 and control pin boss portion 23. Crankpin bearing portion 21 defines a central circular hole in which crankpin 3 is fit. Upper pin boss portion 22 is formed at a first end portion of lower link 4, and the control pin boss portion 23 is formed at a second end portion of lower link 4.

Lower link 4 is an assembly of two half members 31 and 32, so that lower link 4 can be divided by a parting plane 24 into the two members. This two-part structure of lower link 4 facilitates the assembly operation of lower link 4 and crankpin 3. In this example, parting plane 24 passes through the center line of cylindrical center hole of crankpin bearing portion 21, and bisects the cylindrical center hole into two semicylindrical half sections. The half member 31 is an upper half member (also called a lower link upper) including the upper pin boss portion 22, and half member 32 is a lower half member (called a lower link lower) including the control pin boss portion 23. Upper and lower half members 31 and 32 are joined together into the single lower link 4, by at least first and second bolts 33 on both sides of crankpin bearing portion 21. The first bolt (not shown in FIG. 2) is located between upper pin boss portion 22 and crankpin bearing portion 21. Second bolt 33 is located between crankpin bearing portion 21 and control pin boss portion 23. When the engine is installed so that each engine cylinder 19 extends vertically, the upper half member 31 is placed over lower half member 32, and lower half member 32 is under upper half member 31 in the crank case. The first and second bolts extend from the lower side of lower half member 32 upward. The shank of each bolt extends upward from the bolt head at the lowermost position.

Upper pin 6 is rotatably received in a pin hole 22*a* of upper pin boss portion 22. The lower end of upper link 5 is bifurcated and has two arms for supporting both ends of upper pin 6. Upper pin boss portion 22 of lower link 4 is placed between the two arms of the lower end of upper link 5, and arranged to support the middle of upper pin 6 rotatably.

Control pin boss portion 23 of lower link 4 is bifurcated, and has two arms having respective pin holes 23*a* for supporting both ends of control pin 11. A pin boss portion of control link 10 is placed between the two arms of control pin boss portion 23 of lower link 4, and arranged to support the middle of control pin 11 rotatably.

The first bolt on the upper pin boss's side is inserted from below through a bolt through hole formed in lower half member 32, and screwed into a threaded hole formed in upper half member 31. This threaded hole extends toward the upper pin boss portion 22 so that the pin hole 22*a* is located on an extension of the center line of the first bolt. Accordingly, this threaded hole is a blind hole which does not pass through upper half member 31.

Figure 3:
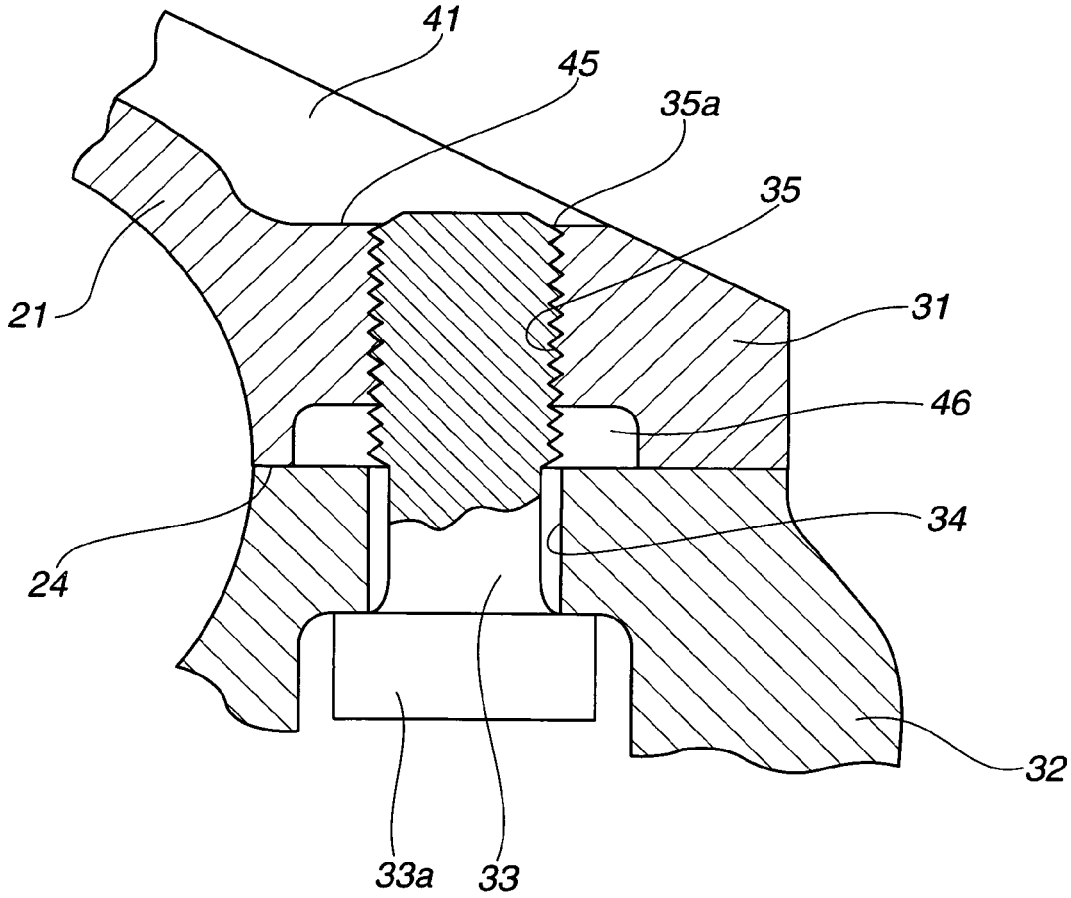
FIG. 3 is a sectional view showing a main portion of the lower link of FIG. 2.

The second bolt 33 on the control pin boss's side is inserted from below through a bolt through hole 34 formed in lower half member 32 and screwed into a threaded hole 35 defined by an internally threaded portion of upper half member 31, as shown in FIG. 3. Bolt through hole 34 extends from a lower open end opened in the bottom of a valley-like depression formed between the two arms of control pin boss portion 23, to an upper open end opened in a flat upper joint surface of the lower half member 32. A head 33*a* of bolt 33 abuts on the bottom of the valley-like depression between the two arms of control pin boss portion 23, and thereby closes the lower open end of bolt through hole 34 of lower half member 32. A threaded portion of the shank of second bolt 33 is screwed into the threaded hole 35 of upper half member 31, and the upper end of the shank of second bolt 33 projects slightly out of the upper open end 35*a* of threaded hole 35, as shown in FIGS. 2 and 3.

A pair of first ribs 41 project upward on both sides of the upper open end 35*a* of threaded hole 35 and thereby form a valley-like depression therebetween. The upper open end 35*a* of the threaded hole 35 is opened in a bottom (45) of this valley-like depression between first ribs 41. First ribs 41 extend along an imaginary plane to which the center line of the center crank pin hole is perpendicular. The first ribs 41 extend toward upper pin boss portion 22 and merge into a single ridge-like projection extending over the crankpin bearing portion, to the upper pin boss portion 22. The upper surfaces of first ribs 41 slope down from an upper position near the upper pin boss portion 22 to a lower position near the control pin boss portion 23. In this example, the upper surfaces of first ribs 41 are flat and inclined with respect to the parting plane 24, as shown in FIGS. 2 and 3. The first ribs 41 extend on the both lateral sides and form the side surfaces of lower half member 31.

A pair of second ribs 42 extend downward, respectively from ends of the first ribs 41, toward the control pin boss portion 23. Second ribs 42 extend in a direction perpendicular to the parting plane 24, and reach the lower joint surface of upper half member 31 formed in the parting plane 24. The threaded hole 35 is located between the second ribs 42 and the crank pin center hole.

A pair of fourth ribs 44 extend, on both sides of the threaded hole 35, along the edges of the lower joint surface of upper half member 31 so as to fringe the edges of the lower joint surface. Each fourth rib 44 extends from a first end connected with the crankpin bearing portion, to a second end to which the lower end of one of the second ribs 42 is connected. The lower ends of the second ribs 42 are connected, respectively, with the ends of fourth ribs 44.

The bottom 45 of the valley-like depression formed between first ribs 41 is a long flat region to which the center line of second bolt 33 or threaded hole 35 is perpendicular. Upper open end 35*a* of threaded hole 35 is opened in this flat region 45, upward as viewed in FIG. 3. The end of bolt 33 projects upward slightly beyond the open end 35*a* of threaded hole 35. All the screw thread of threaded hole 35 is engaged in a screw groove formed in bolt 33.

A depressed region 46 is depressed upward, as shown in FIG. 3, from the lower joint surface of upper half member 31. The lower open end of threaded hole 35 is opened at the center of this depressed region 46. Accordingly, bolt 33 is surrounded by the depressed region 46. This depressed region 46 has a flat bottom (upper) surface in which the lower open end of threaded hole 35 is open.

Figure 7:
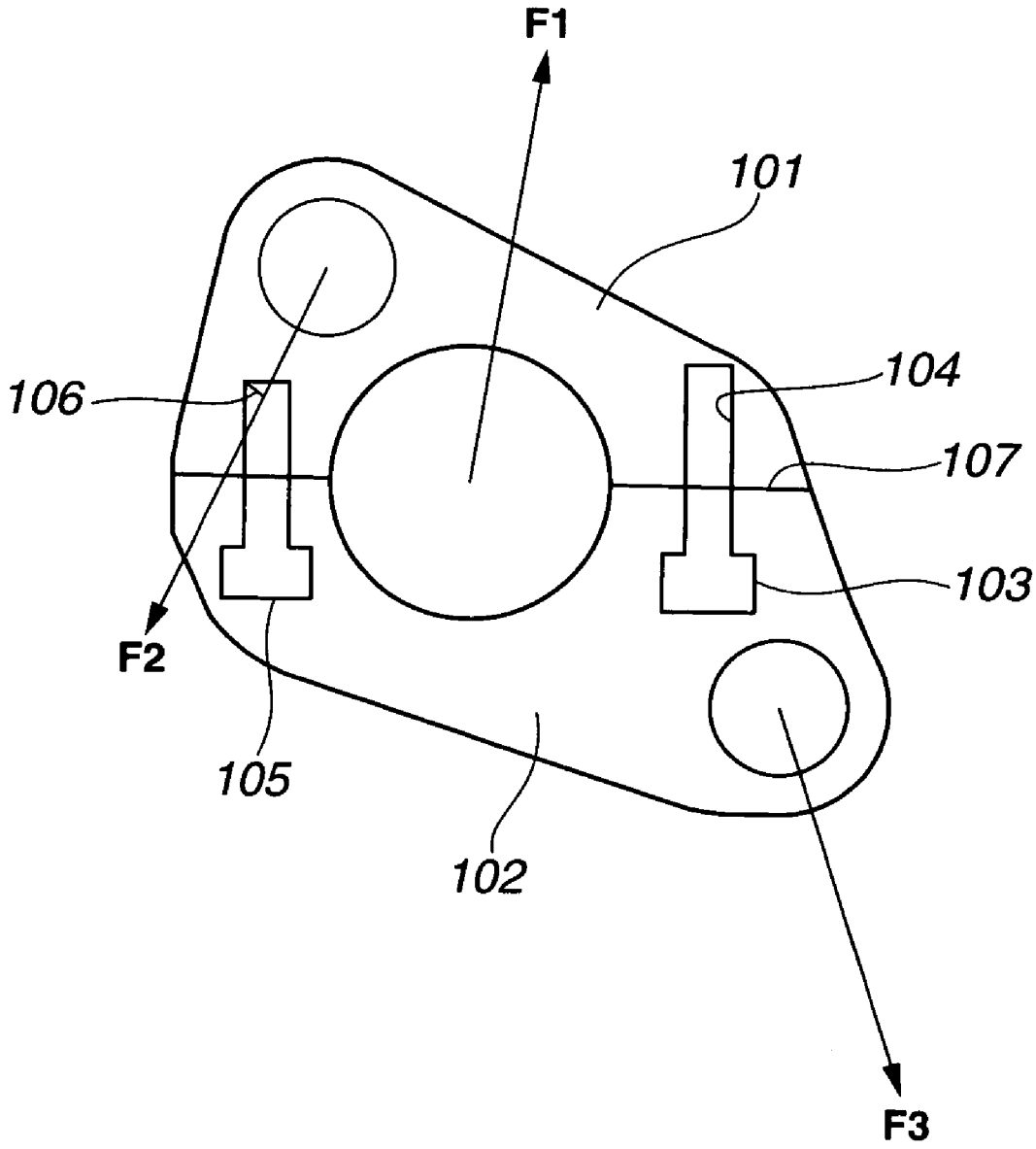
FIG. 7 is a schematic view for showing forces applied to a lower link to illustrate effects of the lower link according to each illustrated embodiment.

To facilitate understanding the effects of the lower link according to the first embodiment, FIG. 7 illustrates the directions of forces F1, F2 and F3 inputted to a lower link from a crankpin, an upper pin and a control pin at the time of explosive combustion. By these great forces F1, F2 and F3 acting in opposite directions, great stress is produced in the lower link. Therefore, bolts 103 and 105 joining an upper half member (or lower link upper) 101 and a lower half member (lower link lower) 102 are required to have sufficient axial forces to keep the upper and lower half members 101 and 102 joined together without being separated in a parting plane 107. As a result, each of internally threaded portions 104 and 106 in which bolts 103 and 105 are tightened receives stress concentration due to the bolt axial force and stress due to the load of the lower link. Moreover, each of the internally treaded portions 104 and 106 receives great moment due to forces acting on both sides in the opposite directions. Therefore, the durability around the internally threaded portions 104 and 106 is important. Furthermore, if the surface pressure is low in the parting plane 107 defined by the joint surfaces of the upper and lower half members, the durability is decreased by fretting wear due to opening and closing in parting plane 107.

In the case of the lower link according to the first embodiment, too, the lower link receives great load along a plane to which the crankpin center line is perpendicular because of the input forces from crankpin bearing portion 21, upper pin boss portion 22 and control pin boss portion 23. However, the load is transferred through the rigid first ribs 41 and second ribs 42 to fourth ribs 44 extending in the parting plane 24. That is, the stress is transmitted through the path formed away from the threaded portion 35 by the rib structure, and accordingly the stress transmitted to the threaded portion is decreased. Consequently, this rib structure can reduce the average stress and stress amplitude in the threaded portion, and improve the durability of the lower link.

Fourth ribs 44 provided in parting plane 24 act to prevent separation of upper and lower half members 31 and 32 in parting plane 24, so that the fretting wear in parting plane 24 is restrained and the durability of bolt 33 is improved. Moreover, because of the depressed portion 46 depressed from parting plane 24 as shown in FIG. 3, the axial force of bolt 33 acts in the circumference of depressed portion 46 spaced from bolt 33 in parting plane 24, so that the separation in parting plane is prevented effectively. Moreover, depressed portion 46 decreases the contact area in parting plane 24 between upper and lower half members 31 and 32, and thereby increases the effect of preventing the separation by increasing the surface pressure.

Upper end 35*a* of threaded through hole 35 is opened in the flat upper surface region 45, so that there are no rounded corners adjacent to upper open end 35*a*. This arrangement prevents addition of stress concentration in a rounded corner and stress concentration due to notch or groove of the threaded portion 35, and thereby improves the durability.

Figure 4:
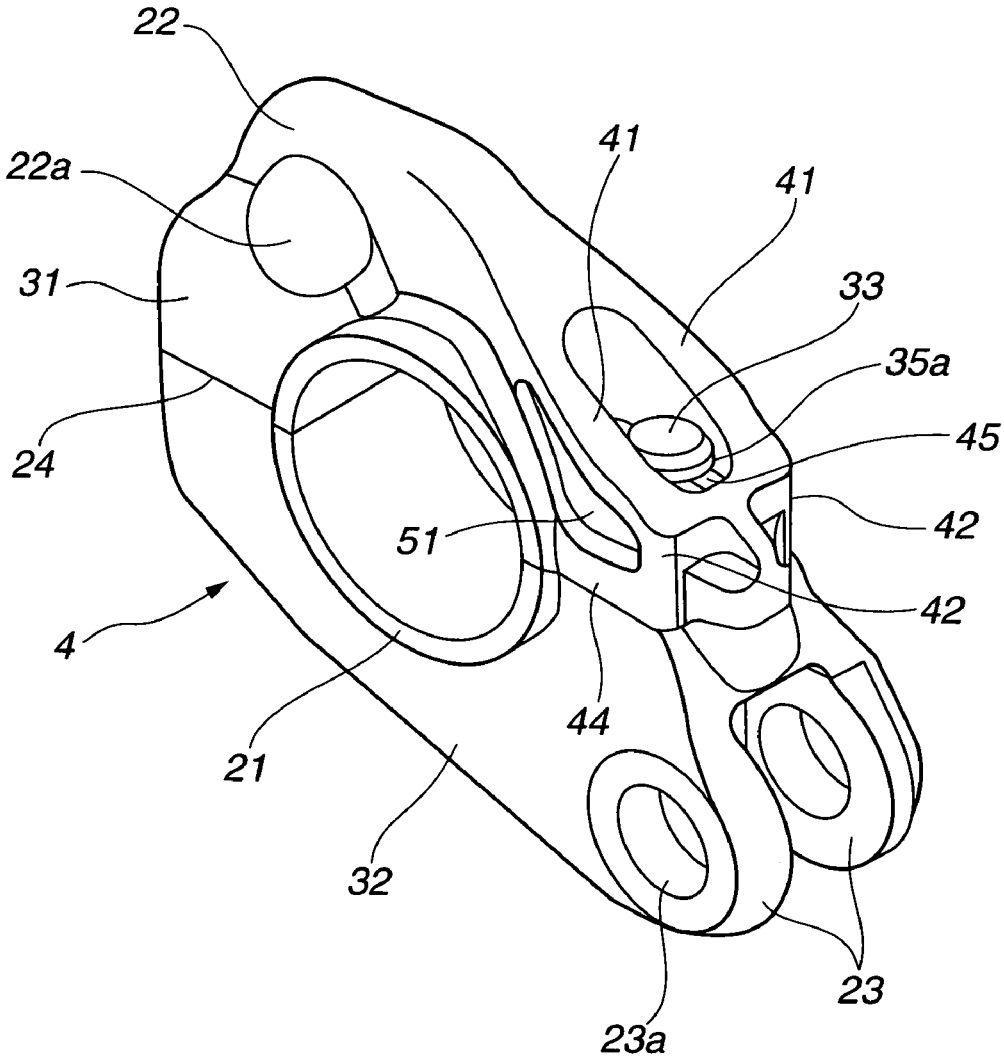
FIG. 4 is a perspective view showing a lower link according to a second embodiment.

FIG. 4 shows a lower link according to a second embodiment of the present invention, which can be used in the engine of FIG. 1, in place of the lower link of the first embodiment. Lower link 4 shown in FIG. 4 includes lateral depressions 51 depressed, respectively, from the side surfaces of upper half member 31 to decrease the rigidity. In each side surface, lateral depression 51 is surrounded by the crankpin bearing portion 21, the upper edge portion of first rib 41, second rib 42 and fourth rib 44, and depressed toward the threaded through hole 35, in the axial direction of the crankpin along the center line of the center hole. By the reduction of the wall thickness in the inner portion formed between the bottoms of the lateral depressions 51 depressed from the respective side surfaces, the inner portion formed with the threaded through hole 35 is lowered in rigidity as compared to the rib structure enclosing the inner portion like a skeletal structure. Therefore, stress is transmitted securely through the rib structure and the transmission of stress is reduced to the threaded portion.

Figure 5:
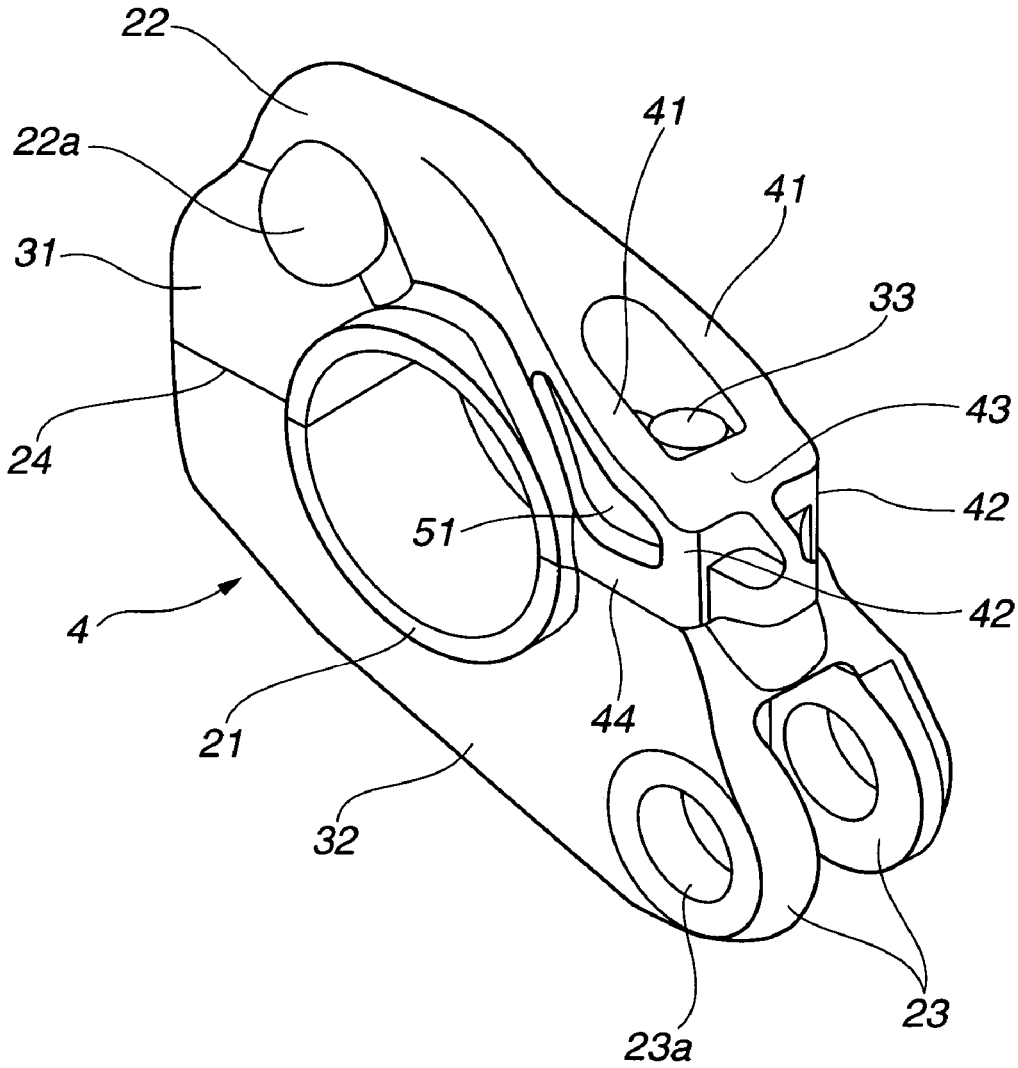
FIG. 5 is a perspective view showing a lower link according to a third embodiment.

FIG. 5 shows a lower link 4 according to a third embodiment, which can be used in the engine of FIG. 1, in place of the lower link of the first embodiment. Lower link 4 shown in FIG. 5 further includes a third rib 43 extending along the crankpin axis or the center line of the center hole, and connecting ends of first ribs 41. Threaded through hole 35 is located between crankpin bearing portion 21 and third rib 43 which is near control pin boss portion 23. First ribs 41 extend on both sides of threaded through hole 35 in a direction away from crankpin bearing portion 21 toward control pin boss portion 23 and terminate at the ends which are connected by third rib 43. Upper open end 35*a* of threaded through hole 35 is surrounded and walled by the first ribs 41 and third rib 43. Moreover, third rib 43 connects the upper ends of second ribs 42. Third rib 43 further increases the rigidity of the rib structure of first ribs 41 and second ribs 42, and load is transferred securely by the rib structure. The upper surface of third rib 43 is flat and continuous with the flat upper surfaces of first ribs 41, to the advantage of machining or forming operation. The continuous upper flat surface of first ribs 41 and third rib 43 slopes down in a direction from upper pin boss portion 22 toward control pin boss portion 23, so that the distance of the sloping flat upper surface of first ribs 41 and third rib 43 from the parting plane 24 is decreased gradually in the direction toward control pin boss portion 23.

Figure 6:
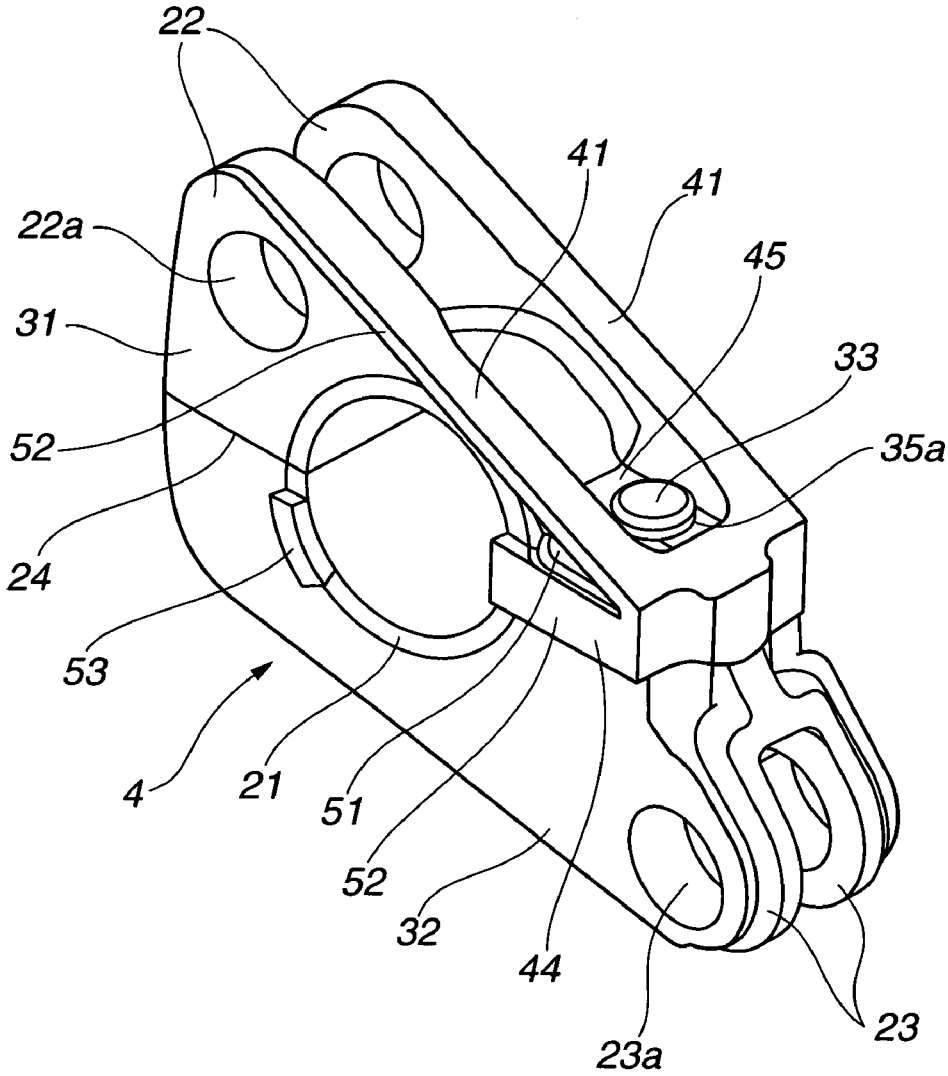
FIG. 6 is a perspective view showing a lower link according to a fourth embodiment.

FIG. 6 shows a lower link according to a fourth embodiment, which can be used in the engine of FIG. 1, in place of the lower link of the first embodiment. In the fourth embodiment, the upper pin boss portion 22 is bifurcated and composed of first and second arms formed with respective pin holes 22*a* for supporting both ends of upper pin 6. The lower end of upper link 5 is placed between the first and second arms of upper pin boss portion 22 of lower link 4, and arranged to support the middle of upper pin 6. On each of the lateral sides of upper half member 31 of lower link 4, the arm of upper pin boss portion 22 is continuous with the first rib 41 as shown in FIG. 6, and the arm of upper pin boss portion 22 and first rib 41 extend continuously along a plane to which the center line of the center hole or the axis of the crankpin is perpendicular. The upper surfaces of the arm of upper pin boss portion 22 and the first rib 41 form a single continuous flat surface which is inclined with respect to the parting plane 24 and which slopes down from upper pin boss portion 22 toward control pin boss portion 23. Therefore, load is transferred effectively from upper pin boss portion 22 to control pin boss portion 23, through the reinforced portion extending from the first end of upper half member 31, to the second end near control pin boss portion 23, without being led toward the threaded portion.

In the example shown in FIG. 6, the side of the upper edge portion of first rib 41 and the side of the fourth rib 44 on one side at least are made flat for serving as thrust bearing surface 52. Moreover, crankpin bearing portion 21 is formed with a projection having a flat thrust bearing surface 53 which is shaped like a circular arc and which is positioned at a circumferential position around the center hole diagonally opposite to the fourth rib 44, approximately 180° apart from the position of fourth rib 44. These thrust bearing surfaces 52 and 53 abut on the side surface of crank web 16 or counterweight 15, and determines the axial position of crankshaft 1.

This application is based on a prior Japanese Patent Application No. 2004-372471 filed on Dec. 24, 2004. The entire contents of this Japanese Patent Application No. 2004-372471 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A lower link for a piston crank mechanism of an internal combustion engine, comprising:

a first half member which includes, a first half of a crankpin bearing portion defining a central hole adapted to receive a crankpin of a crankshaft, a first pin boss portion located on a first side of the crankpin bearing portion and adapted to receive a first pin to connect the lower link with a first link which is one of an upper link having a first end connected with a piston of the engine and a second end connected with the lower link, and a control link having a first end connected with the lower link and a second end mounted swingably on the engine, and a bolt through hole extending through the first half member; and a second half member which is joined with the first half member by a first bolt located on one side of the crankpin bearing portion and a second bolt located on the other side of the crankpin bearing portion, and which includes, a second half of the crankpin bearing portion which is joined with the first half of the crankpin bearing portion to make up a whole of the crankpin bearing portion, a second pin boss portion formed on a second side of the crankpin bearing portion opposite to the first side and adapted to receive a second pin to connect the lower link with a second link which is the other of the upper link and the control link, an internally threaded portion defining a threaded through hole which extends, through the second half member, from a first open end to a second open end and arranged to receive the second bolt inserted through the bolt through hole of the first half member and screwed into the threaded through hole from the first open end to the second open end, to join a joint surface of the first half member and a joint surface of the second half member together, and a load transfer portion which is made greater in rigidity than the internally threaded portion so as to separate, from the internally threaded portion, a stress transfer path transmitting stress acting in the lower link among the first pin boss portion, the crankpin bearing portion and the second pin boss portion.

2. The lower link as claimed in claim 1, wherein the load transfer portion of the second half member comprises a pair of first ribs extending, on both sides of the second open end of the threaded through hole, along an imaginary intersecting plane to which an imaginary center line of the central hole of the crankpin bearing portion is perpendicular, and a pair of second ribs each extending from one of the first ribs to the joint surface of the second half member.

3. The lower link as claimed in claim 2, wherein the second half member comprises a flat region extending, between the first ribs, along an imaginary plane to which a center line of the threaded through hole is perpendicular; the first ribs project from both sides of the flat region so as to form a depression resembling a valley and having a bottom formed by the flat region; and the second open end of the threaded through hole is opened in the flat region.

4. The lower link as claimed in claim 2, wherein the second half member further comprises a third rib which connects ends of the first ribs; the threaded through hole is surrounded by the first ribs and the third rib; and the threaded through hole is located between the central hole of the crankpin bearing portion and the third rib.

5. The lower link as claimed in claim 2, wherein the second half member further comprises a pair of fourth ribs extending, on both sides of the threaded hole, alongside the joint surface of the second half member.

6. The lower link as claimed in claim 5, wherein at least one of the first ribs and fourth ribs includes a thrust bearing surface.

7. The lower link as claimed in claim 5, wherein the second half member of the lower link is formed with lateral depressions depressed, respectively, from side surfaces of the second half member toward the threaded through hole of the internally threaded portion, in a direction along the center line of the central hole of the crankpin bearing portion, and in each side surface of the second half member, the lateral depression is surrounded by the crankpin bearing portion, the first rib, the second rib and the fourth rib.

8. The lower link as claimed in claim 2, wherein the second pin boss portion of the second half member is bifurcated, and includes first and second arms to support both ends of the second pin; and the first and second arms of the second pin boss portion extend continuously to the first ribs, respectively.

9. The lower link as claimed in claim 2, wherein each of the first ribs includes an upper flat surface which extends continuously to an upper flat surface of one of the second ribs to form a continuous upper flat surface.

10. The lower link as claimed in claim 1, wherein the second half member of the lower link is formed with a depression depressed from a side surface of the lower link toward the threaded through hole of the internally threaded portion, in a direction along an imaginary center line of the central hole of the crankpin bearing portion.

11. The lower link as claimed in claim 1, wherein the first and second half members are joined in a parting plane to which an input direction of a maximum load from the crankpin is perpendicular.

12. The lower link as claimed in claim 1, wherein the second half member further comprises a depressed region depressed from the joint surface of the second half member, and the first open end of the threaded through hole is opened in the depressed region.

13. The lower link as claimed in claim 1, wherein the lower link is a component of the piston crank mechanism arranged to vary a compression ratio of the engine by shifting a swing support point of the second end of the control link.

14. An internal combustion engine comprising:

an engine block formed with a cylinder;

a piston slidably received in the cylinder;

a crankshaft including a crankpin; and a link mechanism connecting the piston and crankpin, and including the lower link as claimed in claim 1.

15. A lower link for a piston crank mechanism of an internal combustion engine, comprising:

an upper pin boss portion adapted to be connected through an upper pin with a first end of an upper link having a second end connected with a piston of the engine;

a control pin boss portion adapted to be connected through a control pin with a first end of a control link having a second end to be supported swingably on the engine;

a crankpin bearing portion which defines a central hole adapted to receive a crankpin of a crankshaft and which is located between the upper pin boss portion and the control pin boss portion;

an upper half member including a first side portion formed with the upper pin boss portion, a second side portion and a middle portion located between the first and second side portions and formed with a half of the crankpin bearing portion;

a lower half member including a first side portion formed with the control pin boss portion, a second side portion and a middle portion located between the first and second side portions of the lower half member and formed with a half of the crankpin bearing portion;

a plurality of bolts joining the first side portion of the upper half member with the second side portion of the lower half member, and the first side portion of the lower half member with the second side portion of the upper half member;

at least one of the upper and lower half members being a rib-reinforced half member which further includes, an inner portion defining a threaded through hole extending through the second side portion of the rib-reinforced half member, including first and second open ends, and receiving one of the bolts screwed into the threaded through hole from the first open end to the second open end, and a reinforcing rib structure framing the inner portion.

16. The lower link as claimed in claim 15, wherein the reinforcing rib structure comprises a pair of first ribs extending on both sides of the second open end of the threaded through hole and defining a depression extending along a plane to which a center line of the central hole of the crankpin bearing portion is perpendicular, and having a bottom in which the second open end of the threaded through hole is opened.

17. The lower link as claimed in claim 1, wherein the bolt through hole is unthreaded, and wherein an axis of the bolt through hole is parallel to an axis of the internally threaded portion.

18. The lower link as claimed in claim 1, wherein the first and second bolts have respective bolt heads, and wherein the heads are positioned opposite the load transfer portion with respect to the first half member and the second half member.

19. The lower link as claimed in claim 1, wherein the first half member and the second half member are monolithic structures, respectively.

* * * * *